United States Patent [19]

Taylor et al.

[11] 4,322,113

[45] Mar. 30, 1982

[54] EXCAVATING MACHINES FOR EXCAVATING ROCK AND MINERALS HAVING FIRST AND SECOND ALTERNATIVE MODES OF CONTROL

[75] Inventors: Timothy P. Taylor, Melbourne; Joseph Dowell; Francis A. Haskew, both of Burton-on-Trent, all of England

[73] Assignee: Coal Industry (Patents) Limited, London, England

[21] Appl. No.: 137,011

[22] Filed: Apr. 3, 1980

[30] Foreign Application Priority Data

Jun. 22, 1979 [GB] United Kingdom ..... 21819/79

[51] Int. Cl.[3] ..... E21C 27/24; E21D 9/08

[52] U.S. Cl. ..... 299/1; 173/9; 299/75

[58] Field of Search ..... 299/1; 173/7-9

[56] References Cited

U.S. PATENT DOCUMENTS 2,334,009 11/1943 Jeffrey ..... 299/1
2,841,379 7/1958 Driehaus ..... 173/8 X

FOREIGN PATENT DOCUMENTS 1071462 6/1967 United Kingdom .
1082491 9/1967 United Kingdom .
1139372 1/1969 United Kingdom .
1182666 3/1970 United Kingdom .
1225807 3/1971 United Kingdom .
1383756 2/1975 United Kingdom .
1477974 6/1977 United Kingdom .
1486978 9/1977 United Kingdom .
1501113 2/1978 United Kingdom .

*Primary Examiner*—Ernest R. Purser
*Attorney, Agent, or Firm*—Stevens, Davis, Miller & Mosher

[57] ABSTRACT

A excavating machine for excavating rock and minerals from a working face having a carriage with a boom support. A cutter carrying boom is moveably supported by the boom support, and a means is provided for moving the boom relative to the carriage. A drive means is included with a sensing control means for controlling the movement of the boom relative to the carriage. The sensing control means senses a parameter proportional to the reaction cutting force on the cutter. Control over the movement of the boom is provided in two alternative modes of control. A rate mode control for controlling the machine in accordance with a preselected rate of the output of the drive means is provided, as well as a load mode control in which the movement of the boom is controlled maintaining the reaction cutting force exerted by the cutter substantially at or below a certain value.

11 Claims, 7 Drawing Figures

EXCAVATING MACHINES FOR EXCAVATING ROCK AND MINERALS HAVING FIRST AND SECOND ALTERNATIVE MODES OF CONTROL

This invention relates to excavating machines for excavating rock or mineral from a working face.

In particular, although not exclusively, the present invention relates to excavating machines for excavating rock or mineral from an underground working face to extend an underground mine roadway or a tunnel.

It is known for such an excavating machine to comprise a floor mounted carriage located in the roadway or tunnel and advanceable towards the working face and including a boom support component, a boom moveably supported by said component and means for urging the boom to move relatively to the carriage such that in use, a driven rotary cutter mounted on the boom is moved relatively to the working face to cut rock or mineral.

Unfortunately, with such a prior known excavating machine the means are controlled irrespectively of the reaction cutting force on the cutter. Consequently during cutting the reaction cutting force can vary depending upon the cutting conditions and upon the current setting of the manual control determined by the machine operator. Such a known cutting practice often leads to inefficient operation.

An object of the present invention is to provide an improved excavating machine which tends to overcome or reduce the above mentioned disadvantage tending to increase the cutting efficiency of the machine.

According to the present invention an excavating machine for excavating rock or mineral from a working face comprises a carriage including a boom support component, a cutter-carrying boom movably supported by said component, means for moving the boom relatively to the carriage, and sensing control means which, in use, when a driven cutter is mounted on the boom sense a parameter substantially proportional to the reaction cutting force exerted on the cutter and control the means for moving the boom relatively to said carriage to tend to maintain the reaction cutting force exerted by the cutter substantially at or below a preselected value.

Preferably, the sensing control means comprises a transducer deriving a signal indicative of the cutter motor power.

Advantageously, the sensing control means comprises a reference signal source and electrical comparator means for comparing the transducer derived signal with the reference signal.

Conveniently, the comparator means derives a signal indicative of the signal comparison.

Preferably, the comparator means derived signal controls the operation of a variable delivery pump to vary the field of pressure fluid to hydraulically actuated means for moving the cutter.

Advantageously, the excavating machine comprises means for over-riding the sensing control means.

By way of example only, one embodiment of the present invention will be described with reference to the accompanying drawings, in which.

Figure 1:
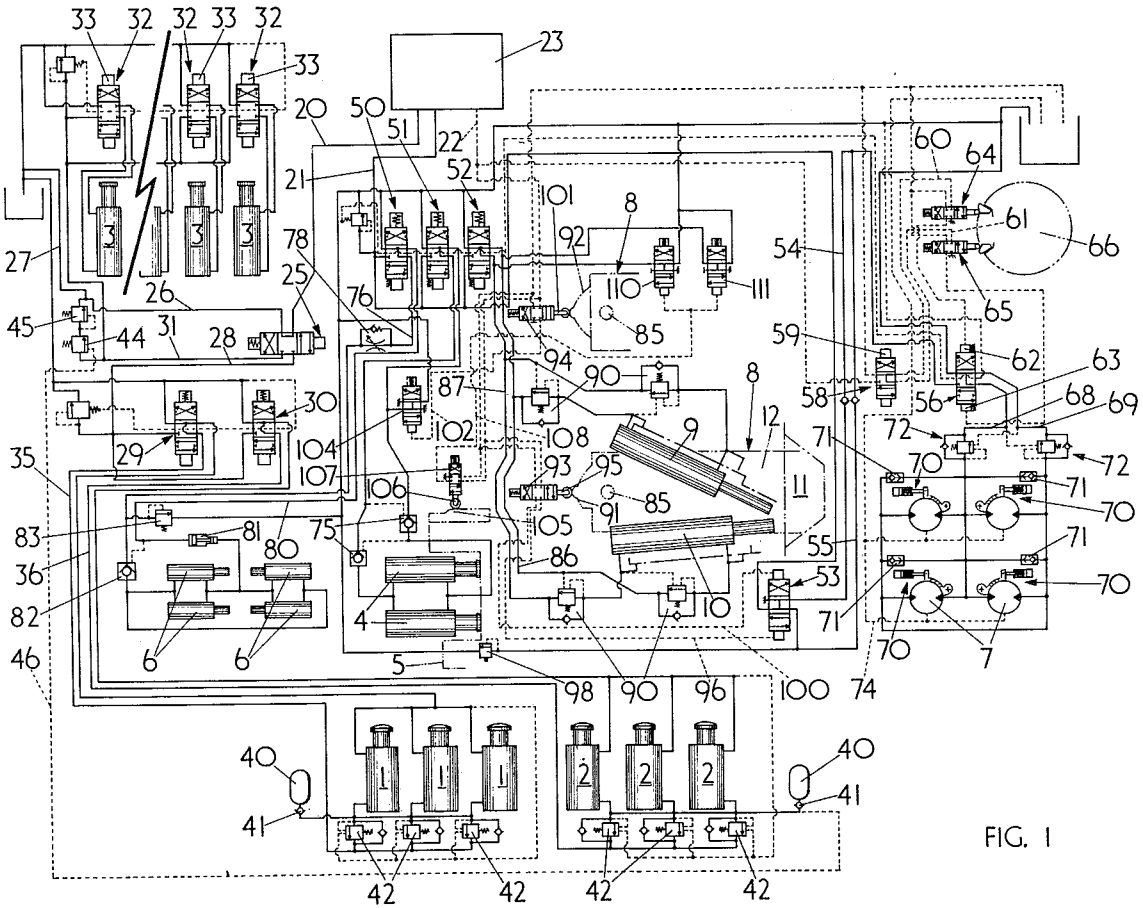
FIG. 1 is a hydraulic circuit diagram for a part of an excavating machine.

FIG. 1 shows a hydraulic circuit diagram for an excavating machine of the type which comprises an outer shield assembly anchorable in an underground roadway or tunnel and including an upper shield assembly and a lower shield assembly connected by two parallel banks of vertically arranged jacks indicated at 1 and 2, respectively, in FIG. 1. The jacks 1 and 2 are operable to urge the upper shield assembly vertically to engage or to disengage the roadway or tunnel surface to anchor or release the machine in the roadway or tunnel.

When the shield assembly is released from the anchored position it can be advanced along the roadway or tunnel towards a working face by actuation of one or more horizontal rams 3 which abut a recently set ring of roof support segments to urge the shield assembly forward.

The excavating machine also comprises a cutting assembly including a slide arrangement 5 (only the outline of a part of which is shown) slideably engaged in a horizontal slideway provided on the shield assembly, the slide arrangement being movable along the slideway under the action of two horizontal advancing rams 4 and being releasably fixed at any desired position along the slideway by wedge arrangements activated by hydraulic wedging rams 6.

The slide arrangement carries a boom support assembly which is rotatable under the action of four hydraulic motors 7 acting through annular gearing and which pivotally supports a boom 8, pivotal movement being controlled by the action of two pairs of hydraulic arms 9 and 10 (only one ram of each pair being shown in FIG. 1).

The boom 8 carries a rotary cutter 11 which is driven about the longitudinal axis of the boom by a drive mechanism including an electric drive motor 12.

In FIG. 1 feed pressure fluid is fed along lines 20 and 21 and pilot pressure is fed along line 22 from a variable supply 23 which will be described later in the specification with reference to FIG. 2. Pressure fluid fed along line 20 is used to activate the jacks 1 and 2 and the rams 3 provided on the shield assembly while pressure fluid fed along line 21 is used to activate the rams 4, 6, 9 and 10 and the motors 7 provided on the cutting assembly. The pilot supply fed along the line 22 control various control valves provided on the cutting assembly as will be described later in the specification.

Pressure fluid along line 20 is controlled by a manually controlled three-position, spring biased control valve 25 which moves under its spring loading into its central position to feed pressure fluid back to tank along lines 26 and 27. The control valve 25 can be moved manually to the left (as seen in FIG. 1) to feed pressure fluid along line 28 to feed two further manually controlled, three-position, spring biased control valves 29 and 30 which control the two banks of jacks 1 and 2 as will be explained later, or it can be moved manually to the right (as seen in FIG. 1) to feed pressure fluid along line 31 to a bank of manually controlled, three-position control valves 32 each of which control the feed of pressure fluid to an associated one of the ram 3. In use, all or selected ones of the valves 32 are manually set in a desired operational mode before the control valve 25 is manually operated to feed pressure fluid to activate the selected rams 3 to advance the shield assembly along the roadway or tunnel towards the working face. The valves 32 are retained in the selected operation mode by detent means 33. Normally all the rams 3 would be activated to advance the shield assembly but in some circumstances it is envisaged that selected operation of some only of the rams 3 will help horizontally steer the machine along a desired path.

When the control valve 25 is operated to feed pressure fluid to the control valves 29 and 30 each of these valves 29 and 30 can be operated to feed pressure fluid directly along lines 35 and 36 to the banks of jacks 1 and 2, respectively. Thus, by operation of both or only one of the valves 29 and/or 30 the machine operator can activate both or only one of the banks of jacks 1 and/or 2 to urge the upper shield assembly vertically relatively to the lower shield assembly.

Each of the two feeds to the banks of jacks 1 and 2 is provided with an accumulator 40 to ensure that when the jacks are urging the shield assembly into the anchored position the pressure supply is maintained irrespective of any adjacent state settling movements which otherwise might have tended to release the assembly from its anchored position or any leakage which might occur in the system. The accumulator outlets are provided with restrictors 41 which ensure that although the flow from the accumulators make up any leakage losses the permitted flow will not be sufficient to override or counteract any desired action when the valves 29 and 30 are operated to release the shield assembly from its anchored position.

Each jack 1 or 2 is provided with a spring biased pilot operated valve 42 which permits controlled lowering of the jacks upon the valves 29 and 30 being operated to lower the upper shield assembly to release the shield assembly from its anchored position, the valves 42 providing a hydraulic lock until a lowering pressure is sensed.

Although in normal operation the valve 25 is operated to ensure that the advancing rams 3 are activated to advance the shield assembly only when the upper shield assembly is disengaged from the anchored position it is possible to activate selected rams 3 while the shield assembly is anchored in order to help support roof support segments during installation of the ring of segments, the selected rams being urged into abutment with partially erected segments which thereby are retained in position until the ring is complete and self supporting. However, in order to ensure the advancing rams cannot advance the anchored shield assembly against the action of the extended jacks 1 and 2 a pilot operated sequence control valve 44 is provided in the feed line 31 which relieves at a pressure below that of relief valve 45 which is set at a lower pressure than the main relief valves and which is not normally in circuit. When the pressure applied to the anchor rams rises to a preselected value, the sequence control valve opens in response to a pilot signal along line 46 to bring relief valve 45 into circuit, thus limiting the pressure and thereby the available force exerted by the advancing rams when the shield is anchored. Hence, when the shield assembly is anchored the pressure available to feed rams 3 is insufficient to advance the shield assembly.

Pressure fluid is fed along supply line 21 to a bank manually operated three-position spring biased control valves 50, 51 and 52, the spring loading acting to return each valve to its central neutral position when the manual control is removed. The line 21 also extends to feed pressure fluid to a pilot operated control valve 53. The valves 50, 51 and 52 control the supply of pressure fluid to the wedging rams 6, to the sumping or slideway rams 4 and to the boom elevating rams 9 and 10, respectively. The valve 53 controls the feed to pressure fluid alternatively along line 54 and 55 to a pilot operated spring biased valve 56 which is pivot operated by a manual control valve 58 having a detent 59 for retaining the valve in a selected position. The valve 58 feeds pilot pressure alternatively along pilot lines 60 or 61 to opposed ends 62 and 63 of the control valve 56, the pilot supply being controlled by two sensing valves 64 and 65 arranged to sense rotation of a cam member 66 fixedly secured for rotation with the boom 8. The sensing valves 64 and 65 are arranged to cut off supply of pilot pressure to the respective side of the control valve 56 should the motor 7 tend to rotate the boom 8 beyond the desired preselected amount. Typically, the motors are allowed to rotate the boom one hundred and eighty degrees in either direction about a central position. This ensures that the electric supply cable to the motor 12 cannot be twisted in one direction by more than the acceptable one hundred and eighty degrees, thus cable damage due to twisting is overcome. When the supply of pilot pressure is cut off from the control valve 56 the valve moves under its spring loading into its central position connecting all supply lines to the motors 7 to exhaust to tank and preventing further rotation of the boom.

When it is desired to rotate the boom support member together with the boom 8 the operator manually moves the control valve 58 into its desired operational mode to feed pilot pressure alternatively along line 60 or 61 to activate the control valve 56, the sensing valves 64 and 65 normally being operational positions to allow straight through feed of pilot pressure. Should either of the sensing valves 64 or 65 be in a tripped position due to detection of over rotation then reversal of the valve 58 to rotate the beam support member in the direction opposite to that which caused the trip to operate is sufficient to reset the tripped valves 64 and 65.

When pilot pressure is fed to activate the valve 56 pressure fluid is fed alternatively along line 68 or 69 to activate the drive motors 7 in a desired direction, the line 69 or 68 constituting a return line back to tank.

Supply pressure fluid to the drive motors 7 is used to activate spring biased brake mechanism 70 provided on each motor 7 to prevent free rotation. The brakes are spring loaded into a brake "on" position and is released by the action of pressure fluid driving the motor in either direction of rotation. Each brake mechanism is fed with pressure fluid via a check valve arrangement 71 sensitive to the fluid pressure inrespective of the desired direction of rotation. A over centre control valve arrangement 72 provides a hydraulic lock arrangement and permits controlled downward movement of the boom when the valves 59 and 56 are operated.

Drain lines 72 are provided to prevent build up of pressure in the motors 7 due to leakage.

The previously mentioned manually operated control valve 51 is operated to advance the cutting assembly 5 of the excavating machine along the slideway towards the working face, the cutter 11 being continuously rotated so that is is sumped fully into the working face. Once the cutter is fully sumped into the face the control valve 51 is released and allowed to move under its spring loading into its central neutral position, check valves 75 providing a hydraulic lock to retain the rams 4 in the desired "sumped-in" position. The operator next manually operates control valve 50 to extend wedging rams 6 to wedge the slide member 5 on the cutting assembly in place on the slideway. The feed along line 76 is passed through a restrictor 78 to ensure the wedging ram 6 are operated slowly tending to prevent the wedge arrangements being jammed into position.

Upon the cutting action being completed the valve 50 is moved in the opposite direction to feed pressure fluid along line 80 to release the wedge arrangements. To ensure the rams 6 can release the wedge arrangements the supply is passed through an intensifier 81 which feeds relatively high pressures to release the wedge arrangements. A pilot operated check valve 82 and relief valve 83 are provided to prevent undesired operation of the rams 6.

Once the cutter 11 is fully sumped into the working face and the slide arrangement 5 is releasably fixedly wedged in the desired position along the slideway the machine operator manually operates the control valve 52 to feed pressure fluid to the boom elevating rams 9 and 10 to pivot the boom about its pivotal mounting 85, the pressure fluid being fed alternatively through lines 86 or 87. As with previously described rams over centre control valves 90 are provided to permit controlled downward movement of the boom.

Two cams 91 and 92 are fixedly attached to the boom for pivotal movement with the boom about the mounting 85. In FIG. 1 the boom 8 is shown twice in order that both the cams 91 and 92 and two associated sensing valves 93 and 94 may be shown clearly.

The cam 91 is arranged to operate the plunger 95 of the sensing valve 93 when the boom is inclined at a relatively small angle to the roadway or tunnel longitudinal axis. When the plunger 94 is depressed by the cam 91 against the action of the valve's spring loading pilot pressure is fed along pilot line 96 to operate the previously mentioned control valve 53 which controls the supply of pressure fluid to activate the rotary drive motors 7. Such operation of the valve 53 feeds pressure fluid to the valve 56 along line 55 which is connected to tank via a pilot operated relief valve 98 set to operate at a lower pressure than the main circuit protection valves and is brought in to reduce the torque which the drive motors can provide when the boom angle is brought below a certain value and thereby reduces the cutting force reaction to a level which is acceptable to the boom assembly. The maximum torque output is determined by maximum force required at the largest radius. If the radius is, for example, halved, then for the same torque, the available force is doubled. The force needed to drive the cutter in normal operational circumstances is no greater than that required to the larger radius and the design of the boom assembly is based on this force. Anything in excess of this is abnormal and requires investigation. Therefore valve 98 will open and stop the cutting operation.

However, when the boom is pivoted about is mounting 85 such that the axis of the boom is inclined at a relatively large angle to the axis of the roadway or tunnel the cam 91 allows the plunger 95 of the valve 93 move under the spring loading and the valve 93 feed pilot pressure along line 100 to operate the valve 53 to feed pressure fluid along line 54 which is not provided with a relatively low set relief valve. Consequently, pressure fluid is fed along line 54 at full feed pressure to activate the rotary drive motors 7.

The cam 92 operates the valve 94 by depressing the plunger 101 against its spring loading when the boom 8 is in a substantially horizontally extending position ie substantially co-axial with the longitudinal axis of the roadway or tunnel.

When the plunger 101 is depressed by the cam 92 the valve 94 feed pilot pressure along line 102 to operate a spring loaded pilot operated valve 104 which thereby feeds pressure fluid to permit the activation of the slideway rams 4 to withdraw the cutting assembly 5 to within the shield assembly. Thus the cam sensing arrangement 92, 94, 101 ensures that the cutting assembly including the boom 8 can only be withdrawn away from the working face and into the shield assembly when the boom is substantially horizontal ie there is no danger of the boom striking any part of the shield assembly when it is withdrawn from the working face. When the boom is other than substantially horizontal the plunger acts under the action of its spring loading exhaust pilot pressure along line 102 and the valve 104 moves under its spring loading to prevent pressure fluid being fed to the ram 4 to withdraw the cutting assembly.

The hydraulic circuit of FIG. 1 includes one further safety feature which ensures that the boom elevating rams 9 and 10 cannot be activated when the cutting assembly is withdrawn along the slideway away from the working face.

The safety feature is constituted by a transverse projection 105 provided on the cutting assembly which when the cutting assembly is withdrawn abuts a plunger 106 of a spring biased pilot operated valve 107. When depressed the plunger causes the valve 107 to feed pilot pressure along the line 108 to operate two spring biased, pilot operated valves 110 and 111 which control the exhaust of pressure fluid from control valve 52 to the rams 9 and 10. Thus, when the cutting assembly is withdrawn the feed lines 86 and 87 to the rams 9 and 10 are connected to exhaust.

The variable supply 23 will now be described in detail with reference to FIG. 2 which shows the previously mentioned supply lines 20 and 21 and pilot line 22.

Figure 3:
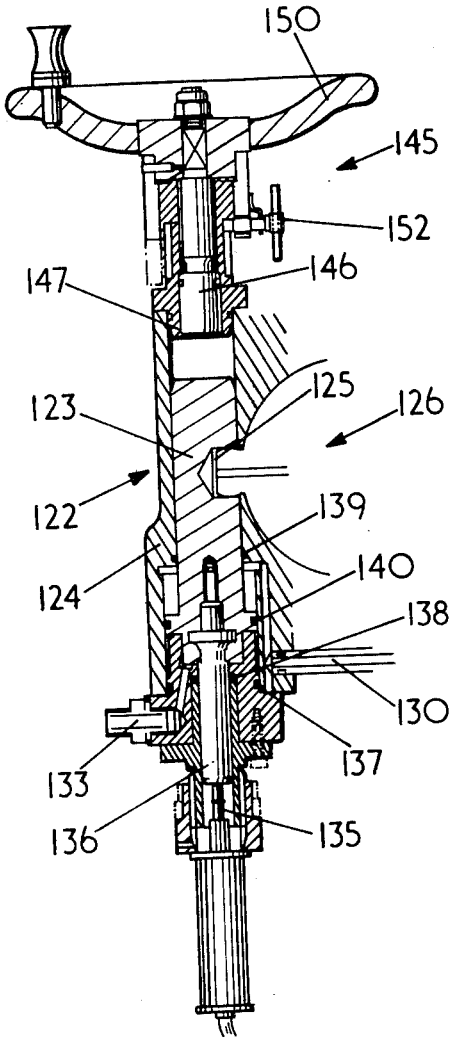
FIG. 3 is an incomplete sectional view through a detail of FIG. 2 and drawn on the enlarged scale.
Figure 4:
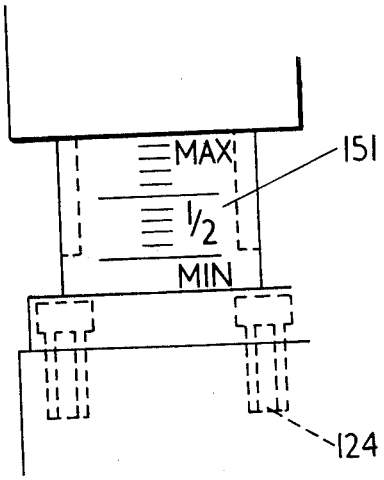
FIG. 4 is a scrap view of a detail of FIG. 3.

The variable supply 23 comprises a variable delivery swash plate pump 120 driven by an electric motor 121 and the swash plate angle of which is controlled by an adjustable piston and cylinder arrangement 122 (described in more detail with reference to FIGS. 3 and 4) including an adjustable position piston 123 and a cylinder 124. The piston has a recess 125 for engagement by a projection on a driven rotary swash plate assembly 126 including a plurality of pistons (not shown) the working strokes of which (and thereby the delivery of which) can be varied by adjusting the position of the piston 123 within the cylinder 124.

The piston 123 is continuously subjected to the delivery pressure from the pump 120 via an inlet port 130 and to a pressure from a control valve arrangement 131 and 132 to be discussed later in this specification via an inlet port 133. The outer casing of an electrical linear transducer 134 is fixedly mounted to the cylinder 124 with its outwardly urged spring loaded plunger 135 urged into abutment with a rod 136 fixedly connected to the piston 123. Seals 137, 138 139 and 140 are provided to prevent leakage of pressure fluid.

The arrangement is such that as the piston moves along the cylinder due to a pressure change at inlet port 133 the piston movement is sensed by the transducer 134 which feeds a derived electrical signal along cable 141 indicative of piston movement to comparator and control means 142 which is discussed later in the specification with reference to FIGS. 5 and 6.

The piston and cylinder arrangement 122 also comprises an adjustable stop arrangement 145 including an abutment stop 146 slideably mounted in a bush 147 fixedly mounted on the cylinder 124, the position of the stop 146 being adjustable along the bush 147 by rotary movement of a hand wheel 150. An indication of the stop position is given by a scale 151 (see particularly FIG. 4) which is gradually covered or uncovered as the stop is moved towards or away from the piston 123. When the position of the stop 145 is not being adjusted the arrangement is locked in a desired set position by a locking screw 152.

The feed of pressure fluid is fed along line 153 via a filter 154 and a sequence valve 155 which ensures sufficient back pressure is always maintained in line 153 to a gear type flow divider 156 comprising two gears connected by a common shaft 157. The flow divider 156 divides the flow from the pump 120 into the lines 20 and 21. Typically the feed of pressure fluid along line 20 to the shield assembly is about one quarter of the feed of pressure fluid along line 21 to the cutting assembly. The three lines 153, 20 and 21 are provided with pilot operated pressure relief valves 158, 159 and 160.

A pressure feed is taken from line 153 along line 161 via a manifold block 162 provided with a pressure gauge 163, and via a filter 154 to a control block 165 including the previously mentioned valves 131 and 132. The pilot line 22 is fed from the manifold block 162.

The line 161 feeds pressure fluid to the servo control valve 132 and to the pilots 166 and 167 of the valve 132. The pilots 166 and 167 are connected to tank via lines 168, 169, 170 and 171, the lines 168 and 169 including variable restrictors 172 and 173 controlled by levers 174 and 175, respectively pivotally connected to one line 176 of a slide arrangement 177. Movement of the slide arrangement 177 of the servo valve 178 is controlled by a moveable rod 179 and two induction coils 180 and 182 both of which are fed with signals from the electrical control and comparator means 142, the signals being fed along line 183. Thus, as the signal along line 183 varies the induction coils 180 and 182 cause the rod to move in one longitudinal direction or the other thereby moving the limb 176 to adjust the settings of both the variable restrictors 172 and 173. The operation of the servo valve 178 and of the variable restrictors 172 and 173 will be explained later in the specification.

Pressure fluid is fed from the valve 132 via line 186 including a spring operated checked valve 187 and variable restrictor 188 to the previously mentioned manually controlled valve 131 which is a two position valve including detent means 189 for retaining the valve in a desired set mode. From the valve 131 pressure fluid is fed along line 190 to the inlet port 133 of the piston and cylinder arrangement 122.

The valve 131 provides a means of connecting supply pressure from line 161 to port 133, thereby by bypassing the servo valve in the event of a malfunction. The pump control then is via the previously mentioned hand wheel 150.

Figure 2:
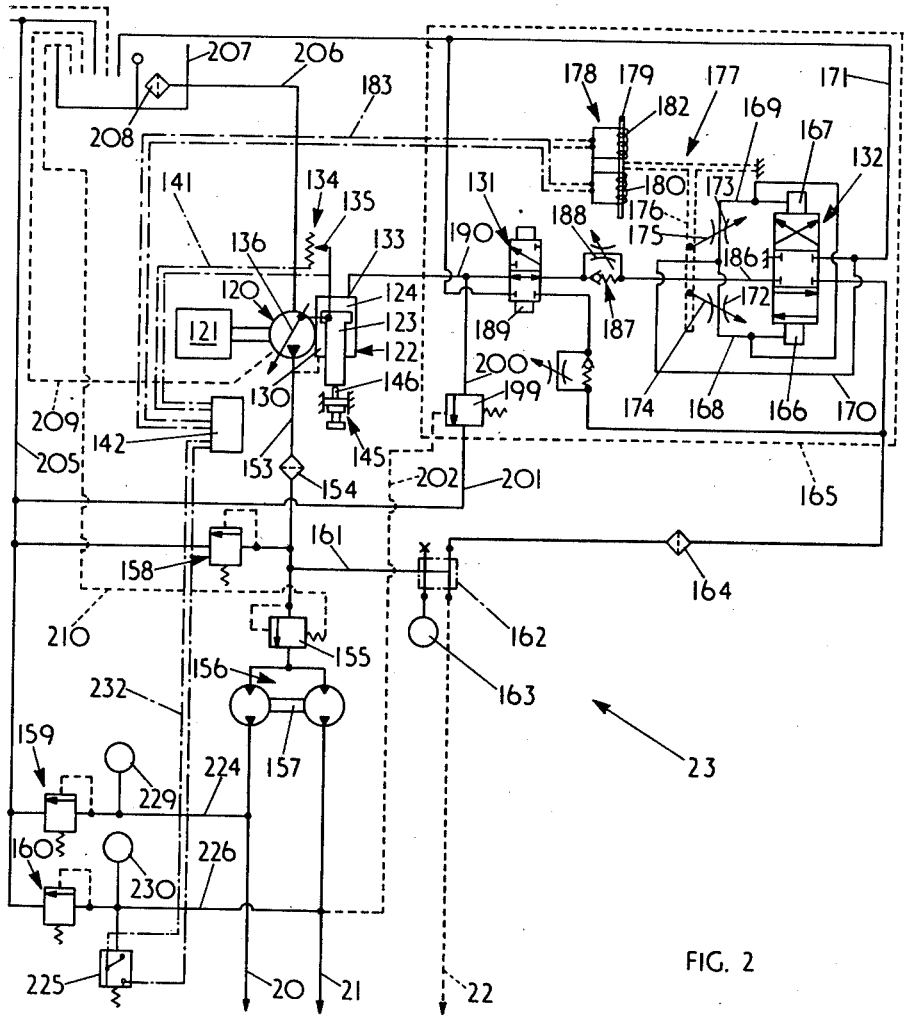
FIG. 2 is an electro-hydraulic circuit diagram for the variable pressure fluid feed arrangement to the circuit of FIG. 1.

The hydraulic circuit of FIG. 2 also includes a pilot operated, spring loaded sequence valve 199 connected to line 190 via line 200 and to exchaust line 205 via line 201. Pilot pressure is fed to the valve 199 via pilot line 202 connected to the pressure fluid feed line 21.

The main hydraulic feed for the pump 120 is along line 206 from tank 207, the line inlet including a filter 208. Two drain lines 209 209 and 210 are provided from the pump 120 and from the sequence valve 155, respectively.

FIG. 2 also shows the electro-hydraulic circuit to include a pressure sensitive switch 225 arranged to sense the fluid pressure in line 21 via line 226 and to feed indicative control signals along cable 232 to the electrical control and comparator means 142. The function of the pressure sensitive switch will be described later in the specification particularly with reference to FIGS. 5 and 6. Pressure gauges 229 and 230 are arranged to indicate the pressures existing in lines 20 and 21 respectively, lines 224 and 226 providing the required connections.

The electrical control circuit for controlling the output of the swash plate pump 120 comprises a power transducer 300 located in the electrical feed from a power supply 302 to the cutter drive motor 12, the power transducer 300 being adapted to produce a voltage output signal proportional to the electrical power drawn by the cutter drive motor 12. The electrical control circuit also comprises the previously mentioned electrical linear transducer 134 which is arranged to produce a voltage output signal proportional to the current setting angle of the swash late of the pump 120 and thereby proportional to the output of the pump 120 neglecting normal operational leakages. The electrical control circuit further comprises two sources 304 and 306 of voltage reference signals against which the output signals of the two transducers 300 and 134 are compared, respectively.

Figure 5:
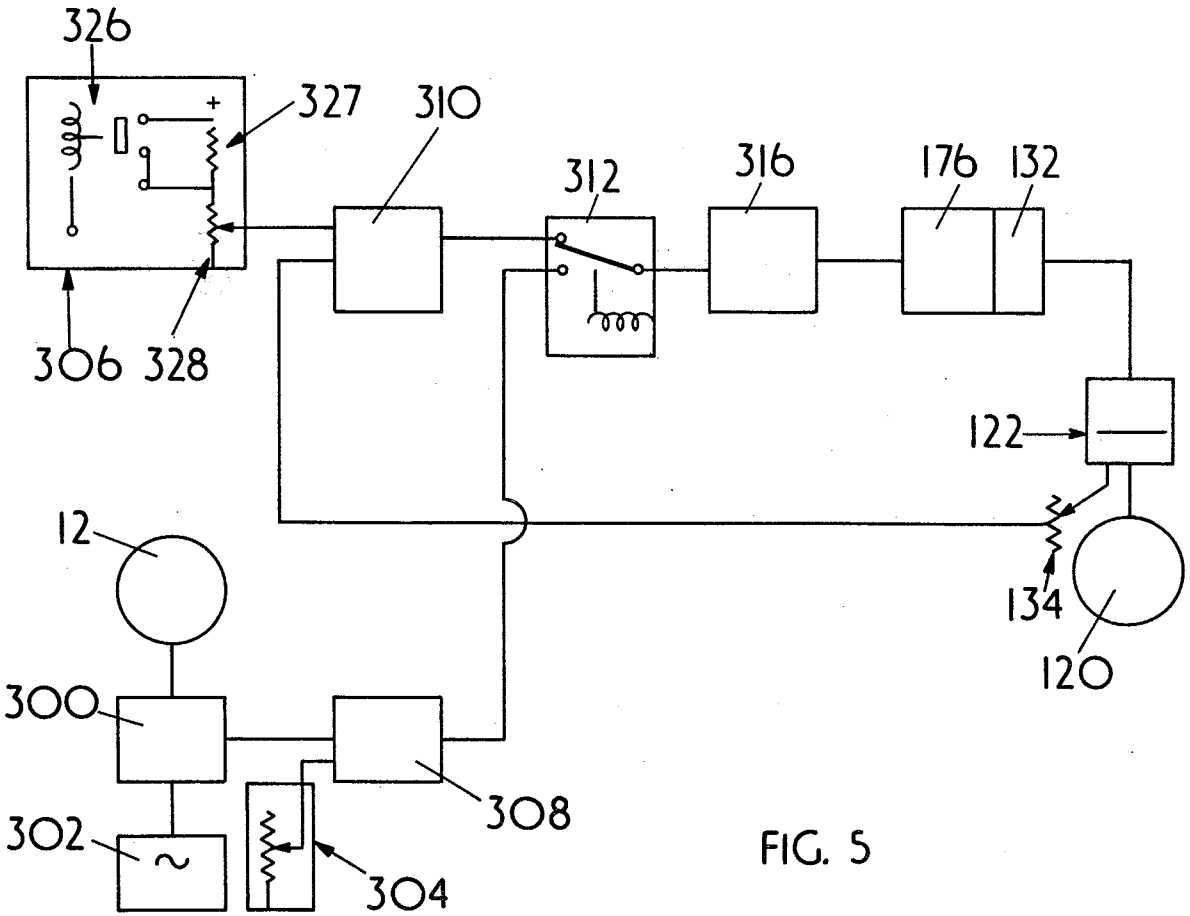
FIG. 5 is a block electrical circuit diagram of a part of the electrical control circuit.

Comparator means 308 and 310 are provided for comparing the associated output and reference signals as indicated in FIG. 5. The remainder of the electrical control circuit show in FIG. 5 comprises a manually operable relay switch 312, a signal amplifier 316 and the servo control valve arrangement 177, 132 for controlling the pump 120.

The manually operated relay switch 312 controls the operational mode of the control between a rate mode control in which the operation of the machine is controlled in accordance with a preselected fixed rate of pump delivery and a load mode control in which the operation of the cutting boom 8 is controlled so as to tend to maintain the reaction cutting force exerted by the cutter at or below a preselected value.

Figure 6:
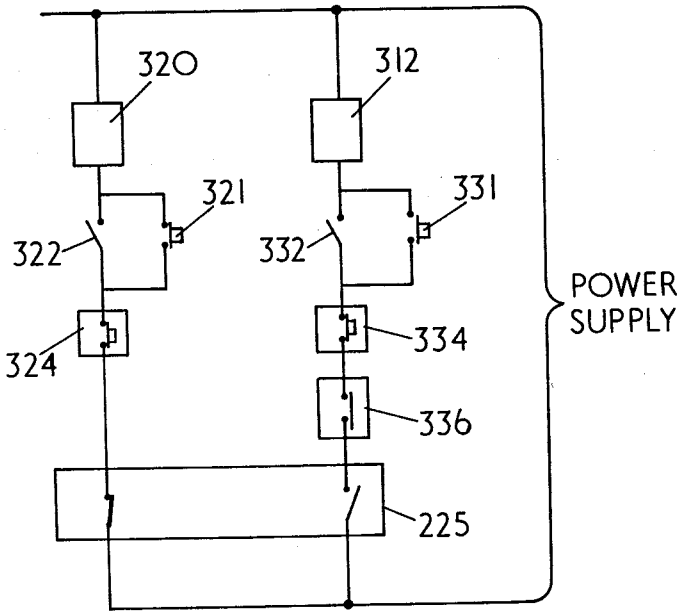
FIG. 6 is a block electrical circuit diagram of another part of the electrical control circuit.

The two electrical control relay circuits associated with the rate and load mode controls are shown in FIG. 6.

The rate mode control circuit comprises rate mode control means 320 including the relay switch 326 associated with the reference signal source 306 which for convenience in FIG. 6 is not shown within the control block 320, the linear transducer 134 and the comparator means 10 for comparing the output from the linear transducer 134 with the reference signal from source 306. Thus, when in rate mode control the comparator means 310 derives a signal indicative of the difference between the output signal from transducer 134 and the preselected reference signal from source 306, the derived indicative signal being fed via the relay switch 312 (which is in a rate mode control position) and via the amplifier 316 to the servo control valve arrangement 176, 132 which thereby, if necessary adjusts the setting of the swash plate pump 120 to the preselected fixed rate of delivery.

Thus, any hydraulic operation on the machine is carried out in accordance with the preselected fixed rate of delivery of pump 120. The output signal of the linear transducer 134 continually is fed back to the comparator means 310 providing a feedback control facility.

The reference signal source 306 has two operation modes, both associated with the rate mode control. In the first mode a relay switch component 326 of the control 320 is open to bring resistor 327 into series with variable resistor 328. Thus, in this first mode of rate mode operation, the reference signal source can be varied manually between, for example, positions associated with zero and twenty five per cent of full operational pump delivery conditions. Thus first mode of rate mode operation is referred to as low rate mode control.

In the second mode of rate mode control the relay switch component 326 of the control 320 is closed to substantially short circuit resistor 327. Thus, the whole of the reference signal is derived by the variable resistor 328. Thus, in this second mode of rate mode operation, the reference signal source can be varied manually between, or example, positions associated with zero and one hundred percent of full operational pump delivery conditions. This second mode of rate mode operation is referred to as high rate mode control.

The high rate mode control circuit also comprises a manually operated control button 321 and a relay switch component 322 which is arranged electrically in parallel with the button 321 and which is held closed once current is sensed to be flowing in the rate mode control circuit. A manual operated button 324 is provided to enable the machine operator to break the high rate mode relay circuit and thereby select low rate mode control. The previously mentioned pressure sensitive switch 225 is included in the high rate mode control circuit and its operation will be described later in the specification.

The load mode, control circuit comprises load mode control means including the relay switch means 312, the power transducer 300, the reference signal source 304 and the comparator means 308 for comparing the output signal from the power transducer 300 with the preselected reference signal. The comparator 308 deriving a signal indicative of the comparison between the two received signals which is fed via the manually operated relay switch 312 and the amplifier 316 to control the servo valve arrangement 176, 132 to ensure the pump feed is varied to maintain the power supply to the cutter drive motor 12 at a preselected valve, the power supply to the drive motor 12 being at a preselected valve, the power supply to the drive motor 12 being detected by the power transducer 300. As the preselected power supply level to the drive motor 12 substantially is proportional to the reaction cutting force on the cutting boom 8 it is possible under load mode to control to control movement of the cutting boom 8 to tend to maintain the reaction cutting force at or below a preselected safe value. Further it is possible in load control to tend to maintain the reaction cutting force at a preselected value associated with the optimum cutting efficiency.

As shown in FIG. 6 the load mode control circuit also comprises a part of the manually operated relay switch 312, a manually operated button 331, and a relay switch component 332 which is held closed once electrical flow is sensed in the load mode control circuit. A manually operated button 334 is provided to enable the machine operator to break the load rate mode relay circuit and thereby select low rate mode control. The load mode control circuit further comprises the pressure sensitive switch 225 and a switch 336 mounted to sense electrical power feed to the cutter drive motor 12 and arranged to close only when power is fed to the cutter drive motor 12 ie when it is assumed the cutter 11 is rotating.

In operation, the excavating machine is installed in an underground mine roadway or tunnel adjacent to the working face to be excavated by the cutter 11 to extend the roadway or tunnel. The cutter motor 12 and pump motor 121 are started to continuously rotate the cutter 11 and to drive the variable delivery pump 120 to feed pressure fluid along line 153, respectively.

The pressure fluid in line 153 builds up until it reaches the setting level determined by sequence valve 155 which then opens to feed pressure fluid to the flow divider 156. As mentioned previously about one quarter of the available pressure fluid fed along line 153 is passed into the shield assembly feed line 20 and the rest is passed into the cutting assembly feed line 21. Typically, about seven to eight gallons per minute are fed to the shield assembly feed line and about twenty to twenty-one gallons per minute are fed to the cutting assembly feed line.

As soon as fluid is fed along line 21 the manual control valve 51 is operated to advance the cutter assembly 5 towards the working face until the cutter 11 is sumped fully into the working face. It should be noted that before the motors 12 and 121 are switched on the shield assembly is anchored in the roadway or tunnel and the boom 8 is in its substantially horizontally extending position as previously described.

When the cutter 11 is sumped fully into the working face the valve 51 is moved to its central position providing a hydraulic lock on rams 4 and the valve 50 is operated causing the wedge rams 6 to wedge the cutting assembly 5 in the desired position along the slideway. The action of the wedge arrangement is to take up any gaps due to manufacturing tolerances or wear to ensure the cutting assembly is firmly anchored to the shield assembly to prevent excessive vibration of the cutting assembly during cutting.

Upon switching on the power to the machine the electric control is in the low rate mode control such that the pump 120 delivers a fixed pressure flow depending upon the manual setting of the reference signal source 306, the pump delivery being between zero and twenty five percent of full pump delivery.

Assuming the cutter 11 is not cutting rock or mineral and therefore only low pressure exists in the cutting feed line 21, the pressure sensitive switch 225 remains in a position allowing the high rate mode control circuit of the reference signal source 306 to be completed (as shown in FIG. 5). Thus, if the operator desires he can activate relay switch 326 to substantially short circuit resistor 327, thereby increasing the reference signal generated by source 306 to within a range of zero to one hundred percent of full pump delivery. Thus, the comparator 310 sensed the difference between the output signal from linear transducer 134 and the newly increased reference signal and correspondingly adjusts the swash plate pump setting to the new increased delivery. Thus, with the control in the high rate mode control by hydraulically power operation can be conducted at the increased rate.

However, as soon as the cutter 11 comes into contact with the rock or mineral face the pressure in the cutting feed line 21 increases. This increase in pressure in line 21 is sensed by the pressure sensitive switch 225 which thereby opens to break the high rate mode relay circuit and switch the control to low rate control. The derived reference signal being switched from the high rate level to the low rate mode level. Thus, the comparator senses the difference in the newly reduced reference signal and the output from the linear transducer 134 and reduces the pump delivery back to the zero to twenty-five percent of full pump delivery. Consequently, any hydraulic operation including the action of moving the cutting boom 8 is correspondingly reduced. Thus the cutter 11 is moved at a relatively slow cutting speed.

Upon the pressure switch sensing the increased pressure in cutting feed line 21 and opening to short circuiting the resistor 327 switch the control from high rate mode control to low rate mode control it simultaneously closes the load mode control line to permit the operator to select load mode control by suitable activation of button 331.

Thus, when the cutter 11 is fully cutting rock or mineral the machine operator can actuate the relay switch 312 to switch the control from the low rate mode control to load mode control when as explained earlier in the specification the cutting boom movement is controlled tending to maintain the reaction cutting force at a preselected value indicative of optimum cutting efficiency.

Should the pressure sensitive switch 225 detect a sufficient fall in the pressure in the cutting feed line 21 it opens to switch off the load mode control and reconnect the low rate mode control.

During high rate mode cntrol the machine operator can activate button 321 to switch the control into low rate mode control.

During load mode control the machine operator can activate button 331 to switch the control into low rate mode control.

The operational position is that if the high rate mode control circuit (ie the left hand circuit in FIG. 6) is energised and the load mode control circuit (ie the right hand circuit in FIG. 6) is de-energised then the machine control will be in high rate mode control. If the load mode control circuit is energised and the high rate mode control circuit is de-energised then the machine control will be in load mode control. However, if both the high rate mode and load mode control circuits are de-energised then the machine control will be in low rate mode control.

In addition, if the pressure in line 21 is below a preselected value the pressure sensitive switch 225 prevents the machine operator selecting the load mode control.

Figure 7:
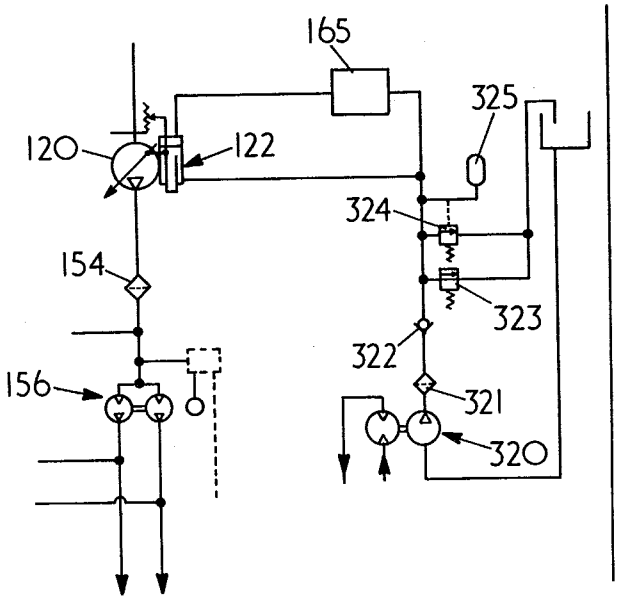
FIG. 7 is an incomplete hydraulic circuit diagram showing an alternative hydraulic circuit to a part of the hydraulic circuit of FIG. 2.

FIG. 7 shows an alternative hydraulic circuit for supplying oil to the pump servo control in which the control block 165 and the adjustable piston and cylinder arrangement 122 are fed from a separate pump 320. The hydraulic supply circuit including a filter 321, a nonreturn valve 322 and spring biased relief valves 323 and 324. An accumulator 325 is provided to even out fluctuations in the supply. Otherwise, the rest of the hydraulic circuit is as described with reference to FIGS. 1 to 6.

We claim:

1. An excavating machine for excavating rock and minerals from a working face, comprising a carriage including a boom support, a cutter-carrying boom movably supported by said boom support, means for moving the boom relative to the carriage, drive means for the machine, and sensing control means for controlling movement of the boom relative to said carriage, said sensing control means sensing a parameter substantially proportional to a reaction cutting force on said cutter, and providing control over said movement in two alternatives modes of control comprising a rate mode control for controlling the machine in accordance with a preselected rate of output of the drive means, and a load mode control in which movement of the boom is controlled to maintain the reaction cutting force exerted by the cutter substantially at or below a preselected value.

2. An excavating machine as claimed in claim 1, in which the control means has a high rate mode control in which substantially the full operative output of the drive means is utilized, and a low rate control in which an output below full operative output of the drive means is utilized.

3. An excavating machine as claimed in claim 2, in which the sensing control means are arranged to sense a supply parameter to a drive motor for the cutter.

4. An excavating machine as claimed in claim 3, in which the sensing control means comprises a transducer deriving a signal indicative of the cutter motor power.

5. An excavating machine as claimed in claim 4, in which the sensing control means comprises a reference signal source and electrical comparator means for comparing the transducer derived signal with a reference signal.

6. An excavating machine as claimed in claim 5, in which the comparator means derives a signal indicative of the signal comparison.

7. An excavating machine as claimed in claim 6, in which the comparator means derived signal controls the operation of a variable delivery pump of the drive means to vary the feed pressure fluid to hydraulically actuated means for moving the cutter.

8. An excavating machine as claimed in claim 2, in which the drive means comprises a variable delivery pump and the low rate mode control operates in a range of pump delivery between zero to twenty-five percent of full pump delivery and the high rate mode control operates in a range of pump delivery between zero and one hundred percent of full pump delivery.

9. An excavating machine as claimed in claim 1, comprising means for overriding the sensing control means.

10. An excavating machine as claimed in claim 1, wherein said rate mode control permits operation in at least two rate modes including a high rate mode and a low rate mode.

11. An excavating machine as claimed in claim 10, wherein said machine switches from one rate mode to another rate mode in response to a change in load on said cutter.

* * * * *